US007104226B2

(12) United States Patent
Endoh et al.

(10) Patent No.: US 7,104,226 B2
(45) Date of Patent: Sep. 12, 2006

(54) CYLINDER LINER COOLING STRUCTURE

(75) Inventors: Tsuneo Endoh, Wako (JP); Kengo Ishimitsu, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/128,242

(22) Filed: May 13, 2005

(65) Prior Publication Data

US 2005/0257756 A1 Nov. 24, 2005

(30) Foreign Application Priority Data

May 24, 2004 (JP) ..... 2004-153579
May 24, 2004 (JP) ..... 2004-153660

(51) Int. Cl.
*F02F 1/14* (2006.01)

(52) U.S. Cl. ..... 123/41.79; 123/41.44; 123/271; 123/668

(58) Field of Classification Search ..... 123/41.79, 123/41.44, 41.67, 41.84, 271, 668
See application file for complete search history.

(56) References Cited

U.S. PATENT DOCUMENTS 6,079,375 A * 6/2000 Duerr et al. ..... 123/41.72

FOREIGN PATENT DOCUMENTS

JP 6-80821 U 11/1994
JP 2002-364456 A 12/2002

* cited by examiner

*Primary Examiner*—Tony M. Argenbright
*Assistant Examiner*—Katrina Harris
(74) *Attorney, Agent, or Firm*—Birch, Stewart. Kolasch & Birch, LLP

(57) ABSTRACT

This invention relates to a cooling structure for cooling a cylinder liner by circulating coolant in a water jacket formed along an outer periphery of the cylinder liner. This cooling structure includes an annular first water reservoir for temporarily storing coolant. This first water reservoir allows the coolant to uniformly flow circumferentially of the cylinder liner. The cooling structure also includes a plurality of coolant passages provided radially for connecting the first water reservoir to the water jacket. The coolant is caused to strike a part of a wall defining the water jacket substantially vertically from the radial coolant passages, thereby to generate turbulent flow in the coolant to efficiently cool the cylinder liner.

14 Claims, 8 Drawing Sheets

CYLINDER LINER COOLING STRUCTURE

FIELD OF THE INVENTION

The present invention relates to a cylinder liner cooling structure in an internal combustion engine.

BACKGROUND OF THE INVENTION

As a cooling structure of this kind, Japanese Patent Laid-Open Publication No. 2002-364456, for example, discloses a cylinder liner cooling structure which is provided with a sleeve including a plurality of small openings through which coolant flows in a water jacket. This cylinder liner cooling structure will be described with reference to FIG. 8.

As shown in FIG. 8, a sleeve 104 formed with a plurality of openings 103 is provided within a water jacket 101, or more specifically, between an outer wall and a cylinder liner 102 forming the water jacket 101, concentrically with the cylinder liner 102.

Coolant flows from an inlet 106 provided in a lower portion of the water jacket 101 through the openings 103 in the sleeve 104 within the water jacket 101 to an outlet 107 provided in an upper portion of the water jacket 101.

If the coolant inlet 106 is only provided at a single location, for example, the coolant does not flow well circumferentially of the water jacket 101, producing areas where the coolant is likely to stagnate. Consequently, high-temperature spots are produced locally in the cylinder liner 102, resulting in a nonuniform temperature distribution in the cylinder liner 102.

Also, the velocity of flow of the coolant passing through the openings 103 located far from the inlet 106 is smaller than that of the coolant passing through the openings 103 located near the inlet 106, due to the friction force acting on the coolant flow and reduction in the amount of flow by the amount flowing out through the openings 103 located near the inlet 106.

The differences in the flow velocity of the coolant passing through the openings 103 cause differences in the level of turbulence generated in the coolant passing through the openings 103 and striking the cylinder liner 102. In short, generation of turbulence is nonuniform by location within the water jacket 101. This causes heat transfer efficiency to be different by location, and thus causes a nonuniform temperature distribution in the cylinder liner 102 as above, preventing effective cooling of the cylinder liner 102.

Thus, there is a desire for an art which provides a more uniform temperature distribution in a cylinder liner to effectively cool the cylinder liner and increase cooling efficiency.

Japanese Utility Model Laid-Open Publication No. HEI-6-80821, for example, discloses another conventional cylinder liner cooling structure in which bores through which coolant fluid flows are formed in a cylinder liner, and a finned core is inserted into each bore. This cylinder liner cooling structure will be described with reference to FIGS. 9, 10A and 10B.

As shown in FIG. 9, a plurality of bores 202 are formed in a cylinder cover 201 of an internal combustion engine, and finned cores 203 are disposed in the respective bores 202. The clearance between the fins and the inner surface of the bore 202 is set at a predetermined dimension t (see FIG. 10A).

FIG. 10A is an enlarged view of the finned core 203 disposed in the bore 202.

As shown in FIG. 10B, when coolant fluid flows through the bore 202, turbulent flow in the coolant fluid occurs within the bore 202.

The cooling structure shown in FIG. 9 has the elongated bores 202 as passages for coolant fluid, and thus has difficulty in ensuring an adequate amount of flow of the coolant fluid as compared to a system of cooling a cylinder liner by a water jacket, for example, having a disadvantage in cooling capability. Also, since it can only cool portions near the bores 202, it is difficult to uniformly cool the entire cylinder liner by the bores 202 formed in the cylinder liner. If the number of the bores 202 is increased to increase the amount of flow of the coolant fluid, for example, the number of man-hours to form the bores 202 is increased, resulting in an increased manufacturing time.

In addition, since the finned core 203 consists of a shaft member and a large number of fins fixed on the shaft member, it is difficult to keep, in the elongated bore 202, the clearance between each fin and the inner surface of the bore 202 at the predetermined dimension, due to a bend of the shaft member and variations in the outside diameter of the fins. When the clearance exceeds the allowable range, there is no alternative to replacing the finned core 203 to adjust the clearance. There is thus a desire for a structure which allows precise formation of the clearance.

Furthermore, when a cylinder liner integrated with a cylinder block wears, for example, the cylinder liner cannot be replaced. If the cylinder block as a whole is made from cast iron to prevent wear of the cylinder liner, it leads to an increased weight of the cylinder block.

Thus, there is a desire for a cylinder liner cooling structure which allows more uniform cooling, easy manufacturing, and precise formation of a clearance between a distal edge of a fin and a wall opposite to the fin, and also allows replacement of a cylinder liner portion and a reduction in weight of a cylinder block.

SUMMARY OF THE INVENTION

According to the present invention, there is provided a cooling structure for cooling a cylinder liner by circulating coolant supplied from a water pump, in a water jacket formed along an outer periphery of the cylinder liner, which comprises: an annular coolant pool provided around the water jacket for temporarily storing coolant; and a plurality of radial coolant passages for connecting the annular coolant pool to the water jacket; wherein coolant flowing through the radial coolant passages flows into and strikes a part of a wall defining the water jacket, substantially vertically.

Since coolant is once stored in the annular coolant pool as described above, the coolant can reach throughout the annular coolant pool to make the flow of the coolant circumferentially substantially uniform. The coolant can further flow from the radial coolant passages into the water jacket to uniformly supply the coolant circumferentially of the water jacket. Circumferential stagnation of the coolant can thus be prevented to provide a more uniform temperature distribution in the coolant.

Also, coolant can strike part of the wall defining the water jacket substantially vertically from the radial coolant passages to generate uniform turbulent flow in the coolant jetting from the radial coolant passages as well as to provide uniform generation of turbulent flow circumferentially of the water jacket, resulting in increased efficiency of heat transfer from the cylinder liner to the coolant.

In the cooling structure of this invention, as described above, the annular coolant pool is formed around the water jacket; the annular coolant pool is connected to the water jacket by the radial coolant passages; and coolant flowing through the radial coolant passages flows into and strikes a part of the wall defining the water jacket, substantially vertically. The annular coolant pool and the radial coolant passages can thus make the circumferential temperature distribution in the water jacket more uniform; the coolant striking the wall of the water jacket from the radial coolant passages can enhance generation of turbulent flow in the coolant; and the efficiency of heat transfer from the cylinder liner to the coolant can be increased. Accordingly, the cylinder liner can be cooled more effectively, resulting in increased cylinder liner cooling efficiency.

In the present invention, the part of the wall defining the water jacket which the coolant flows into and strikes, is preferably located at an upper portion of the cylinder liner.

Since the wall of the water jacket which the coolant flows into and strikes is located at the upper portion of the cylinder liner, the upper portion of the cylinder liner which is heated most by heat transferred from the combustion chamber can be cooled by the coolant to reduce the temperature difference between the upper and lower portions of the cylinder liner and to reduce heat distortion of the cylinder liner.

According to the present invention, there is also provided a cooling structure for cooling a cylinder liner by circulating coolant supplied from a water pump, in a water jacket formed along an outer periphery of the cylinder liner, which comprises: the water jacket formed by the cylinder liner and a peripheral wall of a cylinder block body surrounding the cylinder liner; at least one fin formed at one of the cylinder liner and the peripheral wall; and a narrow space formed between a distal edge of the fin and the other of the cylinder liner and the peripheral wall; wherein the narrow space causes generation of turbulent flow in the coolant.

Since the water jacket is constituted by the cylinder liner and the peripheral wall surrounding the cylinder liner as described above, the cylinder liner can be directly cooled by a large flow of coolant in the water jacket, resulting in increased cooling efficiency. Also, since the cylinder liner is surrounded by the water jacket, the cylinder liner as a whole can be cooled more uniformly. The temperature distribution in the cylinder liner can thus be made more uniform, and heat distortion of the cylinder liner can be limited. Further, compared to a cooling structure formed with a number of elongated bores, the cooling structure using the water jacket can reduce manufacturing time and cost.

The narrow space preferably has a width of 0.8 mm to 1.0 mm.

By setting the clearance of the narrow space at 0.8 to 1.0 mm, the flow velocity of coolant flowing through the narrow space can be increased to facilitate generation of turbulent flow immediately after the coolant flows through the narrow space. The efficiency of heat transfer from the cylinder liner to the coolant can thus be increased, resulting in effective cooling of the cylinder liner.

If the width of the narrow space is large (that is, if the clearance of the narrow space exceeds 1.0 mm), for example, the amount of coolant flowing through the narrow space is increased, and the flow velocity is reduced. The flow of coolant becomes substantially laminar, making it difficult to generate turbulent flow.

If the clearance of the narrow space is very small (that is, if the clearance of the narrow space is below 0.8 mm), for example, the amount of coolant flowing through the narrow space is significantly reduced, and the flow velocity is also reduced. It thus becomes difficult to generate turbulent flow.

According to the present invention, there is also provided a cooling structure for cooling a cylinder liner by circulating coolant supplied from a water pump, in a water jacket formed along an outer periphery of the cylinder liner, which comprises: a cylinder block body constituting one side wall defining the water jacket; the cylinder liner separate from the cylinder block body, the cylinder liner being fitted in the cylinder block body, constituting another side wall defining the water jacket; at least one fin formed at one of the cylinder block body and the cylinder liner and located within the water jacket; and a narrow space formed between a distal edge of the fin and the other of the cylinder block body and the cylinder liner, through which the coolant flows.

Since the side walls forming the water jacket is constituted by the cylinder block body and the separate cylinder liner, and the narrow space is formed between the fin formed at one of the cylinder block body and the cylinder liner, and the other of the cylinder block body and the cylinder liner, as described above, the fin can be formed easily and precisely at one of the cylinder block body and the cylinder liner to precisely form the narrow space before the cylinder liner of a separate part is fitted in the cylinder block body. Therefore, when a plurality of narrow spaces is provided, for example, generation of turbulent flow in the coolant by the narrow spaces can be made more uniform. Thus, efficiency of heat transfer from the cylinder liner to the coolant can be made more uniform in all the parts of the cylinder liner, resulting in a uniform temperature distribution in the cylinder liner.

Also, since the cylinder liner is separate from the cylinder block body, the cylinder liner can be easily replaced when worn. Further, by making the block body from an aluminum alloy and making the cylinder liner from cast iron, for example, a significant weight reduction can be achieved as compared to making a cylinder block with an integral cylinder liner as a whole from cast iron.

BRIEF DESCRIPTION OF THE DRAWINGS

Preferred embodiments of the present invention will be described in detail below, by way of example only, with reference to the accompanying drawings, in which.

DETAILED DESCRIPTION OF THE PREFERRED EMBODIMENTS

Figure 1:
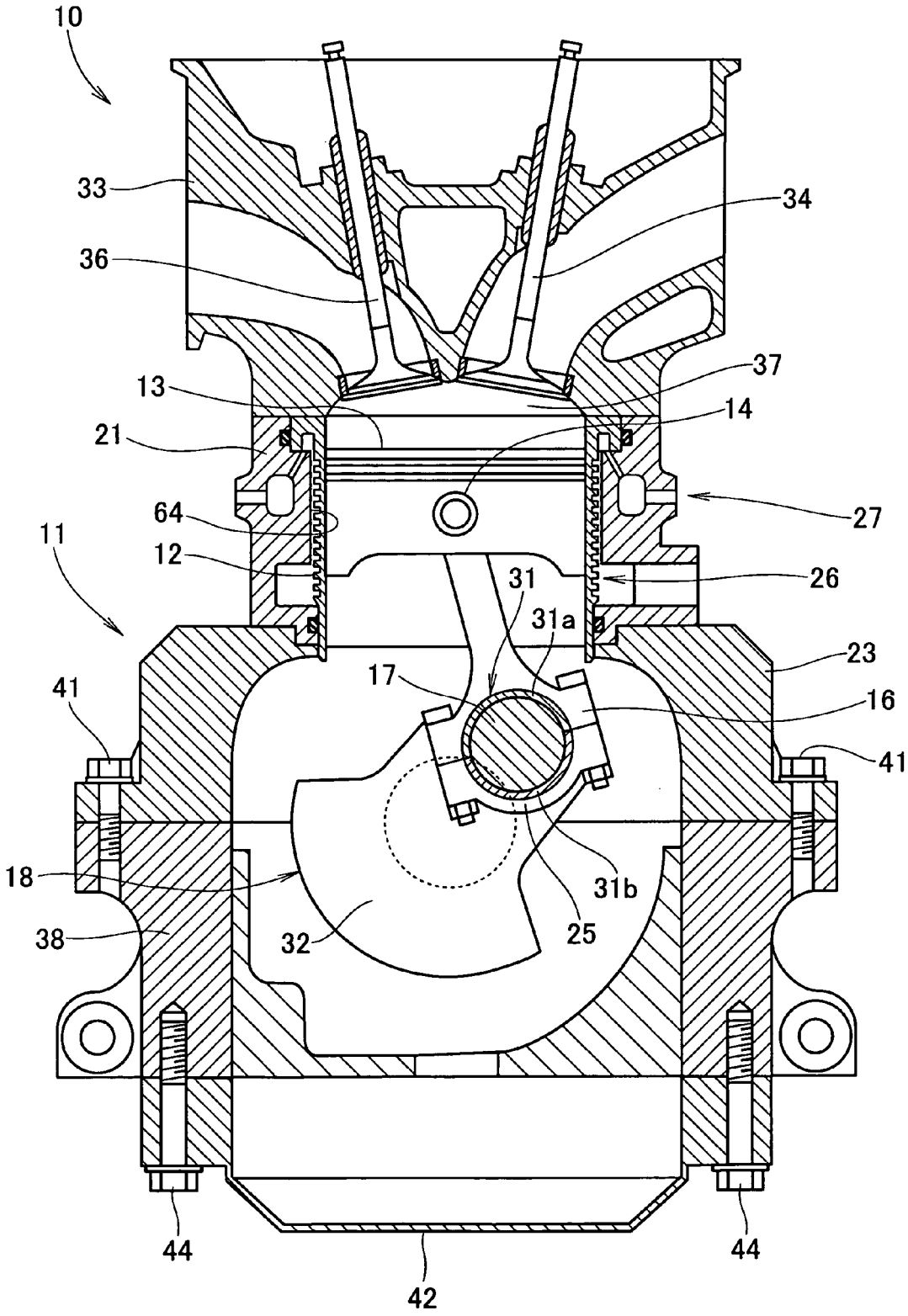
FIG. 1 is a cross-sectional view of an internal combustion engine employing a cylinder liner cooling structure according to the present invention.

An internal combustion engine 10 shown in FIG. 1 includes a cylinder block 11, a piston 13 movably inserted in a cylinder liner 12 which is provided in the cylinder block 11, a connecting rod 16 connected to the piston 13 via a piston pin 14, and a crankshaft 18 rotatably mounted in a lower portion of the cylinder block 11 and swingably supporting the connecting rod 16 by a crankpin 17.

The cylinder block 11 includes a cylinder block body 21, the separate cylinder liner 12 fitted in a liner insertion bore 64 which is formed in the cylinder block body 21, and an upper crankcase 23 mounted to the bottom of the cylinder block body 21.

By fitting the cylinder liner 12 into the liner insertion bore 64, a water jacket 26 is formed between the cylinder block body 21 and the cylinder liner 12. The water jacket 26 constitutes a coolant channel for cooling the cylinder liner 12. The cylinder block body 21 is provided with a cylinder liner cooling portion 27 which includes the water jacket 26.

A plain bearing 31 consists of bearing halves 31*a* and 31*b* interposed between a large end portion 25 of the connecting rod 16 and the crankpin 17. The crankshaft 18 is provided with a counterweight 32. A cylinder head 33 is mounted on top of the cylinder block 11 with a head gasket (not shown) therebetween. Reference numeral 34 denotes an inlet valve; 36, an exhaust valve; 37, a combustion chamber. Reference numeral 38 denotes a lower crankcase which forms a crankcase with the upper crankcase 23. The lower crankcase 38 is mounted to the bottom of the upper crankcase 23 by a plurality of bolts 41. Reference numeral 42 denotes a sump mounted to the bottom of the lower crankcase 38 by a plurality of bolts 44.

Figure 2:
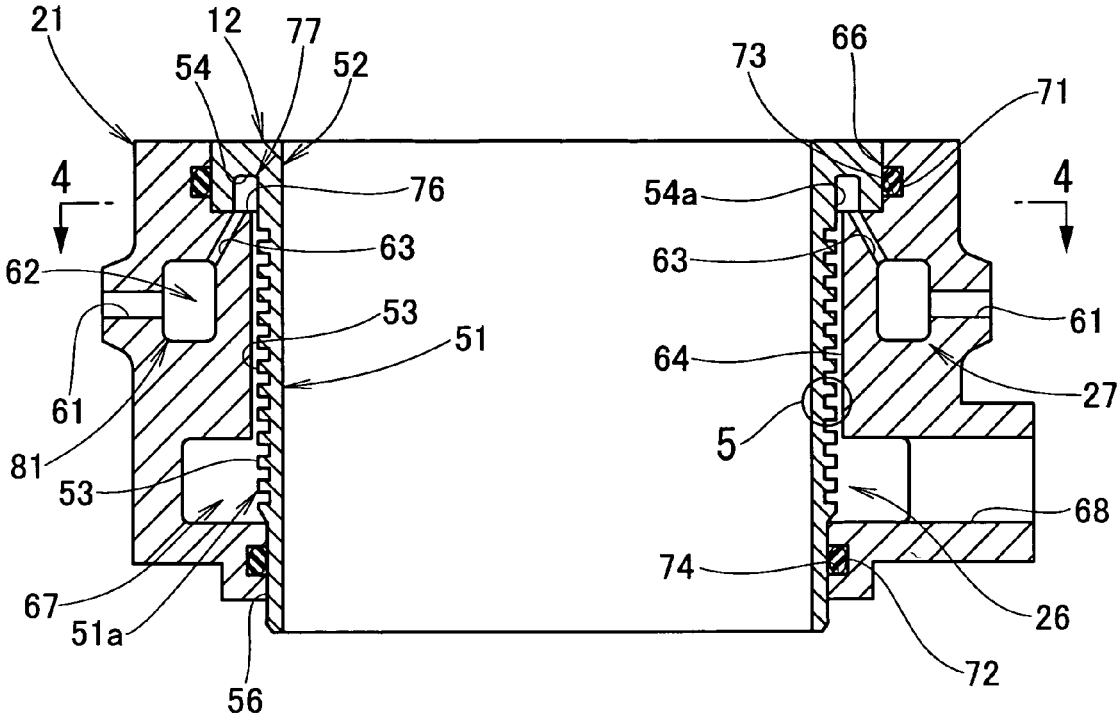
FIG. 2 is a cross-sectional view of the cylinder liner cooling structure shown in FIG. 1.

FIG. 2 illustrates a cylinder liner cooling structure according to the present invention. The cylinder liner 12 includes a cylindrical liner body 51. The liner body 51 has a large-diameter portion 52 of a larger outside diameter integrally formed at one end (upper end) portion thereof, and a plurality of annular fins 53 formed at an outer peripheral surface 51*a* thereof. The large-diameter portion 52 is formed with an annular groove 54 opening downward. The other end (lower end) portion of the liner body 51 includes a small-diameter portion 56 having a smaller outside diameter than the large-diameter portion 52.

The cylinder liner 12 is in the form of constituting part of the water jacket 26, and is what is called a wet liner. Compared to a cylinder liner integrally cast with a cylinder block body in one piece, for example, it is easier to replace a damaged or worn cylinder liner. Further, compared to a dry liner which is not in contact with a water jacket, it has a better cooling capability.

The cylinder block body 21 is provided with a plurality of water inlets 61 connected to a water pump 19 (see FIG. 3), a first water reservoir (annular coolant pool) 62 of an annular space connected to the water inlets 61 for temporarily storing coolant, a plurality of coolant passages (radial coolant passages) 63 in a narrow shape to cause coolant to strike an inner wall 54*a* of the groove 54, the liner insertion bore 64 formed to receive the cylinder liner 12, a large-diameter bore portion 66 formed in a first end portion of the liner insertion bore 64 in which the large-diameter portion 52 of the cylinder liner 12 is fitted, a second water reservoir 67 formed annularly around a second end portion of the liner insertion bore 64 for temporarily storing coolant, a water outlet 68 for discharging coolant from the second water reservoir 67 to a radiator not shown, and O-ring grooves 73 and 74 formed in the first end portion (that is, the large-diameter bore portion 66) and the second end portion for fitting O-rings 71 and 72 thereinto.

Reference numeral 76 denotes a bottom surface of the large-diameter bore portion 66. The bottom surface 76 and the groove 54 form a third water reservoir 77 for temporarily storing coolant and forming turbulence by coolant jetted from the coolant passages 63.

The fins 53 are annular projections formed along a plane orthogonal to the axial direction of the cylinder liner 12.

When the respective opposite end portions of the cylinder block body 21 and the cylinder liner 12 are sealed by the O-rings 71 and 72, the liner insertion bore 64, the bottom surface 76, the groove 54 in the cylinder liner 12, the outer peripheral surface 51*a* of the liner body 51, and the second water reservoir 67 form the water jacket 26. The water jacket 26, the water inlets 61, the first water reservoir 62, and the coolant passages 63 constitute the cylinder liner cooling portion 27.

The water inlets 61, the first water reservoir 62, and the coolant passages 63 constitute a coolant supply portion 81 for supplying coolant to the water jacket 26.

Figure 3:
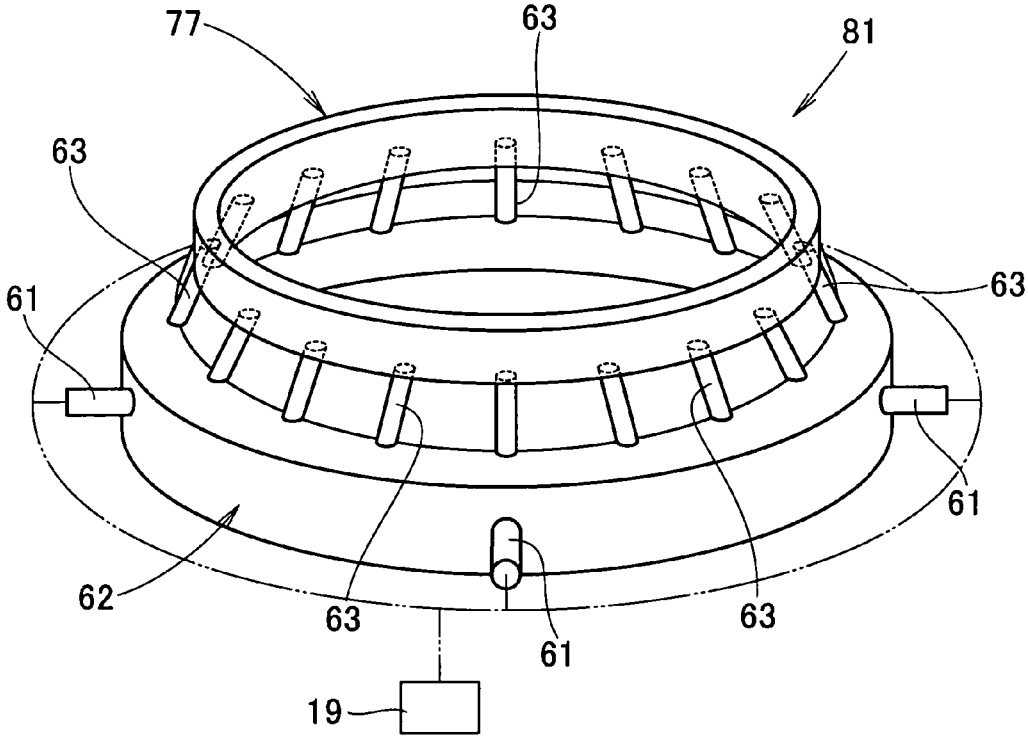
FIG. 3 is a perspective view of a coolant supply portion shown in FIG. 2.

The coolant supply portion 81 is schematically shown in FIG. 3. The annular first water reservoir 62 is connected to the annular third water reservoir 77 by the coolant passages 63. Consequently, the amount of coolant supplied from the first water reservoir 62 to the third water reservoir 77 can be increased, and coolant flowing through the coolant passages 63 can be jetted into the third water reservoir 77, enhancing generation of turbulent flow in the coolant.

Figure 4:
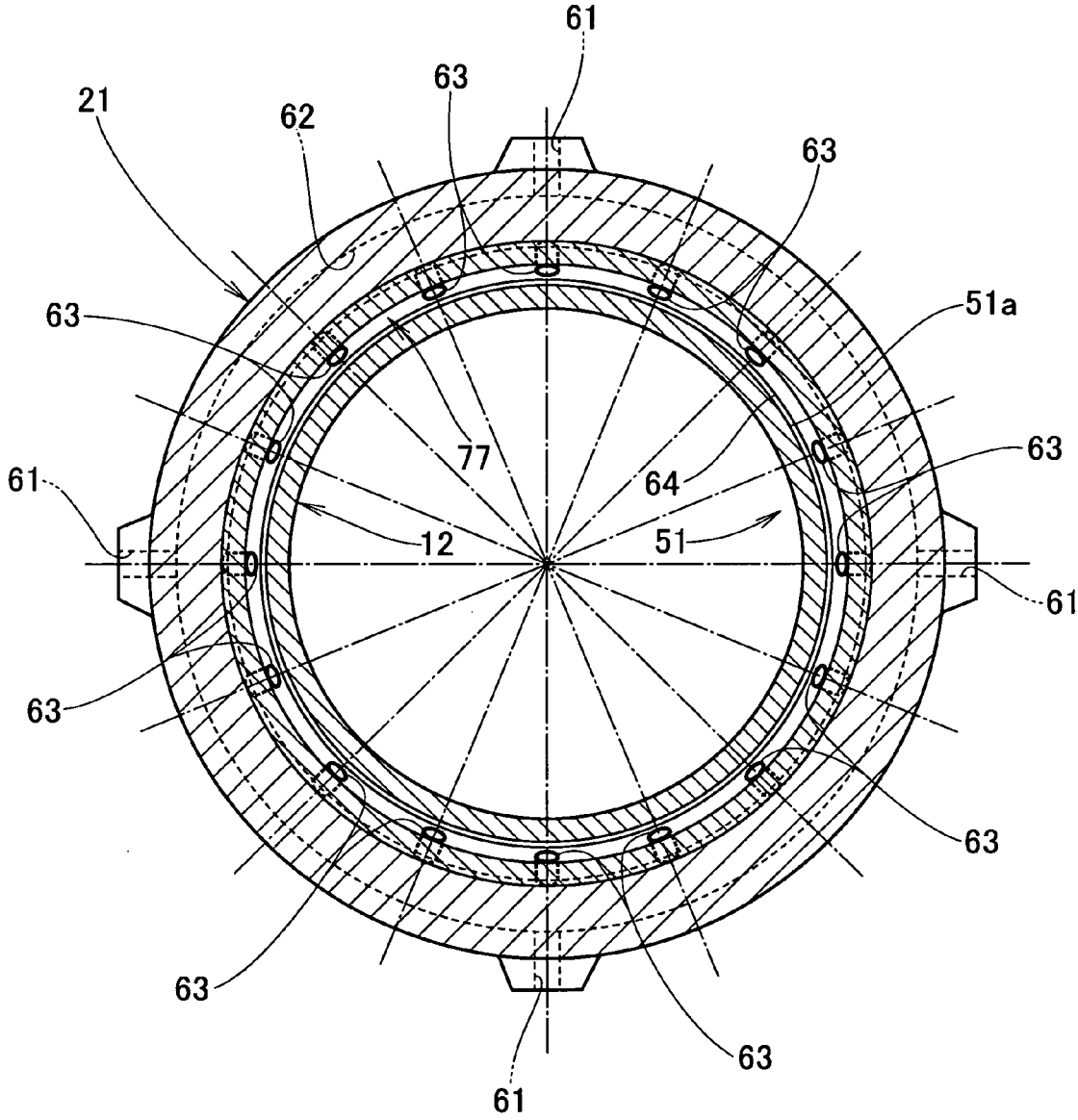
FIG. 4 is a cross-sectional view along line 4—4 in FIG. 2.

As shown in FIG. 4, the coolant passages 63 are arranged radially and circumferentially at equal intervals. With this, coolant is circumferentially uniformly supplied from the first water reservoir 62 to the third water reservoir 77, and an upper portion of the cylinder liner 12 is cooled circumferentially more uniformly. Also, coolant flows circumferentially uniformly from the first water reservoir 62 into a gap between the liner insertion bore 64 and the outer peripheral surface 51*a* of the liner body 51, cooling middle and lower portions of the cylinder liner 12 circumferentially more uniformly as well.

Since coolant flowing from the four water inlets 61 into the first water reservoir 62 is collected in the annular first water reservoir 62 and the flow is stabilized, the coolant is also allowed to flow more uniformly from the first water reservoir 62 into the coolant passages 63.

Figure 5:
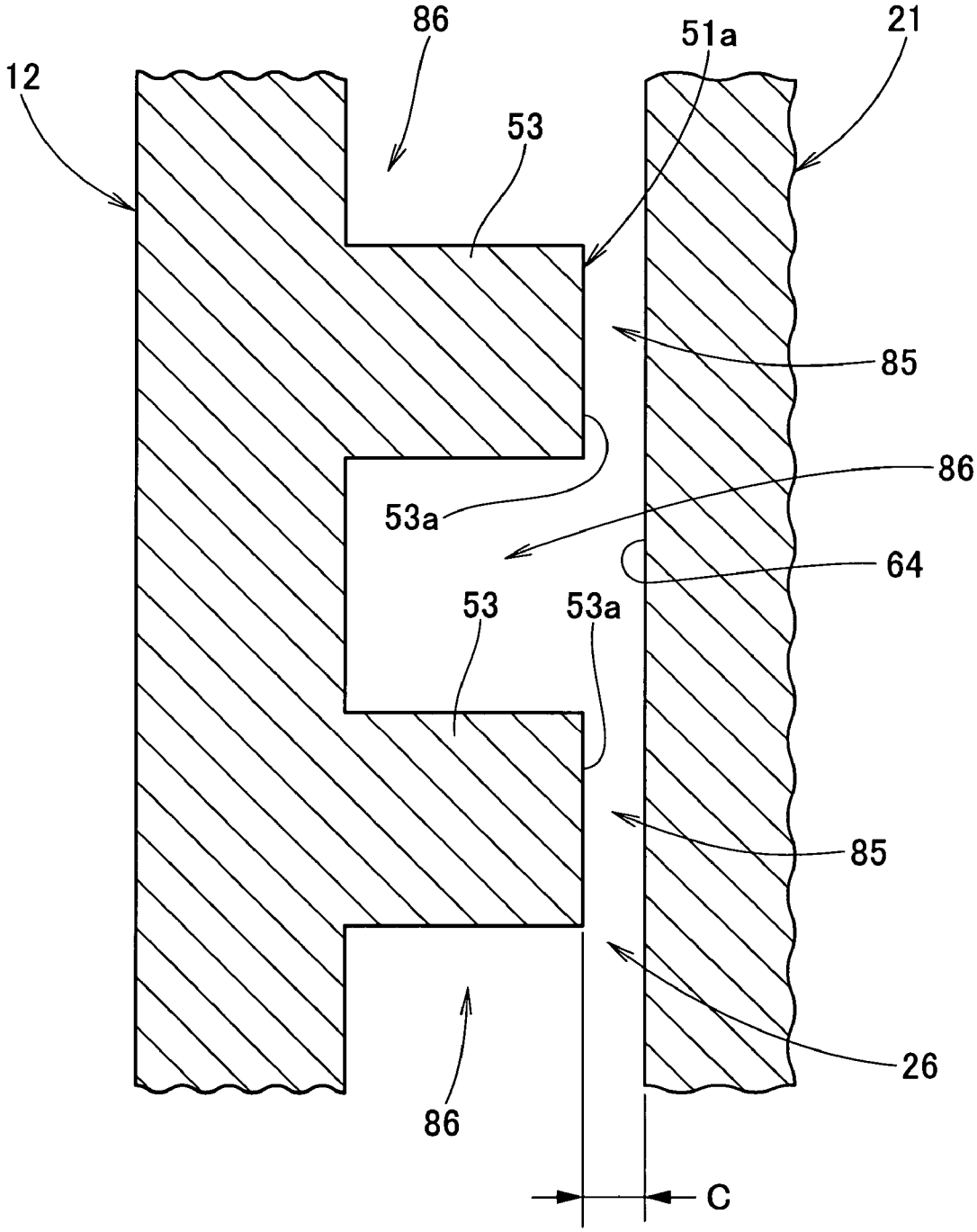
FIG. 5 is an enlarged view of a portion 5 in FIG. 2.

As shown in FIG. 5, radially narrowed annular narrow spaces 85 are formed between distal edges 53*a* of the fins 53 formed at the outer peripheral surface 51*a* of the cylinder liner 12 and the liner insertion bore 64 formed in the cylinder block body 21. Reference numeral 86 denotes an annular inter-fin space between the adjacent fins 53, 53.

The clearance C between the distal edges 53*a* of the fins 53 and a wall forming the liner insertion bore 64 (a wall of the cylinder block body 21), that is, the width of the narrow spaces 85 is about 0.8 mm to 1.0 mm.

Next, the flow of coolant will be described with reference to FIGS. 6 and 7.

Figure 6:
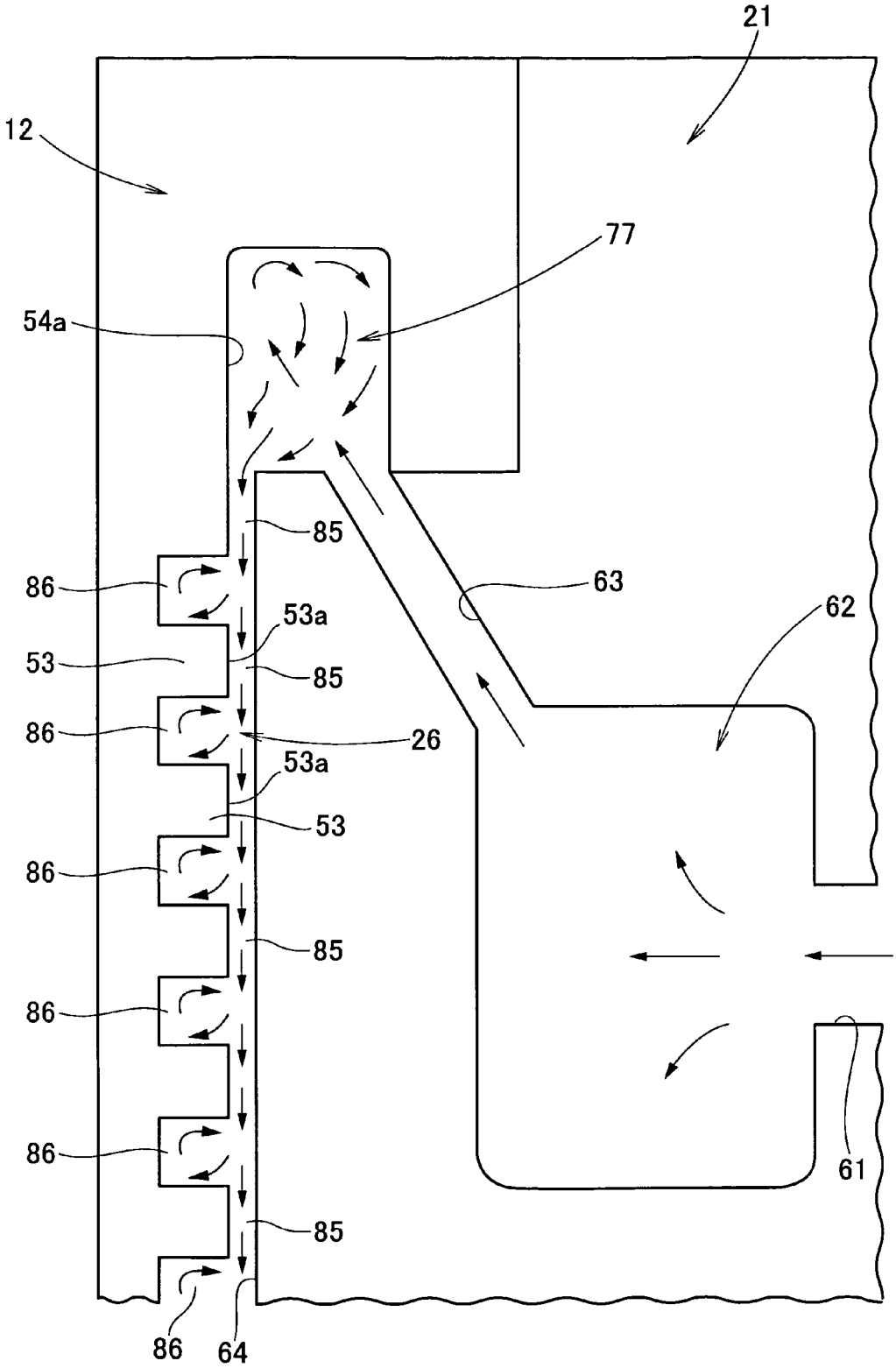
FIG. 6 is a diagram illustrating the operation of a cylinder liner cooling portion according to the present invention.

As shown in FIG. 6, when coolant flows from the water inlets 61 into the first water reservoir 62, the coolant reaches every circumferential corner within the annular first water reservoir 62 substantially uniformly, flowing into the coolant passages 63 substantially uniformly, and flowing from the coolant passages 63 into the annular third water reservoir 77 circumferentially substantially uniformly.

Since the coolant passages 63 are elongated holes, the coolant jets into the third water reservoir 77, striking the inner wall 54*a* of the third water reservoir 77 at a great flow velocity, and thus generating wide turbulent flow within the third water reservoir 77 as shown by arrows.

Then, the coolant flows from the third water reservoir 77 through the gap between the cylinder liner 12 and the liner insertion bore 64 in a direction perpendicular to the fins 53 as shown by arrows, and also circumferentially in the inter-fin spaces 86.

When the coolant flows through the narrow spaces 85, the flow velocity is increased due to the small width of the narrow spaces 85. Thus, turbulence easily occurs immediately after the coolant flows through the narrow spaces 85 (a space adjacent to a downstream portion of the third water reservoir 77 is also a narrow space 85). When the coolant flows from the narrow spaces 85 into the inter-fin spaces 86 of a large volume, the flow velocity of the coolant is reduced rapidly, and turbulent flow occurs widely in the inter-fin spaces 86.

As a result, the turbulent flow in the inter-fin spaces 86 as well as the increased surface area by the fins 53 constantly causes temperature difference between the cylinder liner 12 and the coolant, enhancing heat transfer from the cylinder liner 12 to the coolant, and enabling effective cooling of the cylinder liner 12.

If the clearance between the distal edges 53*a* of the fins 53 and the liner insertion bore 64 is large and the narrow spaces 85 are eliminated (if the width of the narrow spaces 85 exceeds 1.0 mm), for example, the amount of flow of coolant between the distal edges 53*a* of the fins 53 and the liner insertion bore 64 is increased and the flow velocity of the coolant is not increased so much. The flow of the coolant is thus substantially laminar, hardly generating turbulent flow.

Also, if the clearance between the distal edges 53*a* of the fins 53 and the liner insertion bore 64 is very small and the narrow spaces 85 exist (if the width of the narrow spaces 85 is less than 0.8 mm), the amount of flow of coolant between the distal edges 53*a* of the fins 53 and the liner insertion bore 64 is reduced greatly, generating turbulent flow only in part of each inter-fin space 86.

In the present invention, the width of the narrow spaces 85 is set at 0.8 to 1.0 mm so that rapid turbulent flow occurs widely in the inter-fin spaces 86.

The cylinder liner 12 is separate from the cylinder block body 21. Therefore, before the cylinder liner 12 is fitted in the cylinder block body 21, the fins 53 can be formed with a precise height, or outside diameter. If the liner insertion bore 64 in the cylinder block body 21 is formed precisely in diameter (it is also necessary to precisely form the large-diameter portion 52 and the small-diameter portion 56 to be fitted into the cylinder block body 21 shown in FIG. 2), the precision in width of the narrow spaces 85 can be increased. Consequently, generation of turbulent flow in the inter-fin spaces 86 can be made uniform, and the efficiency of heat transfer by coolant can be made more uniform in an axial direction of the cylinder liner 12.

Further, since the coolant passages 63 extend obliquely upward from the first water reservoir 62 and the water jacket 26 extends downward from the third water reservoir 77, coolant rapidly changes direction at acute angles in cross section in the third water reservoir 77, enhancing generation of turbulent flow in the third water reservoir 77.

Figure 7:
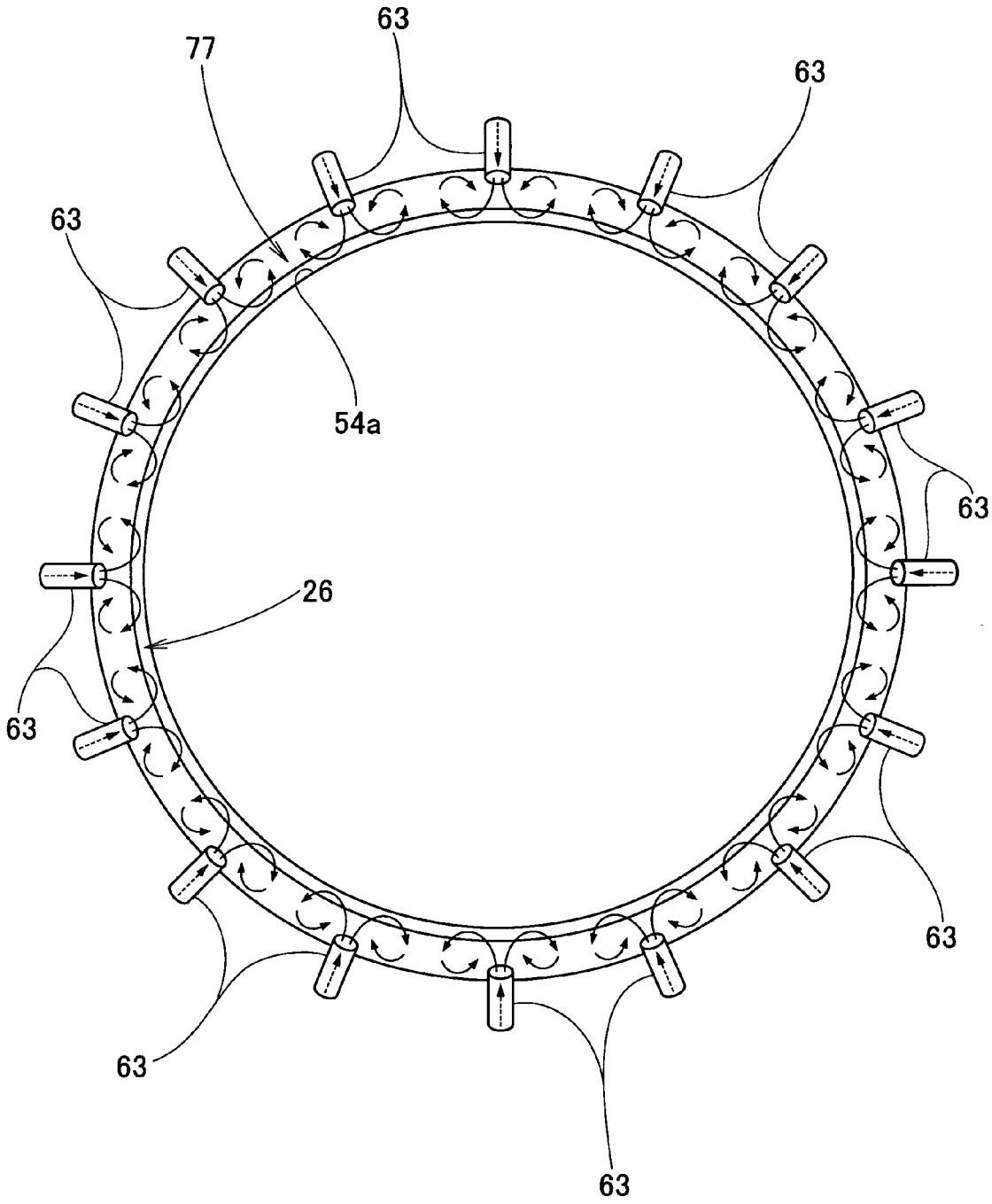
FIG. 7 is a top view illustrating the operation of the cylinder liner cooling portion according to the present invention.
Figure 8:
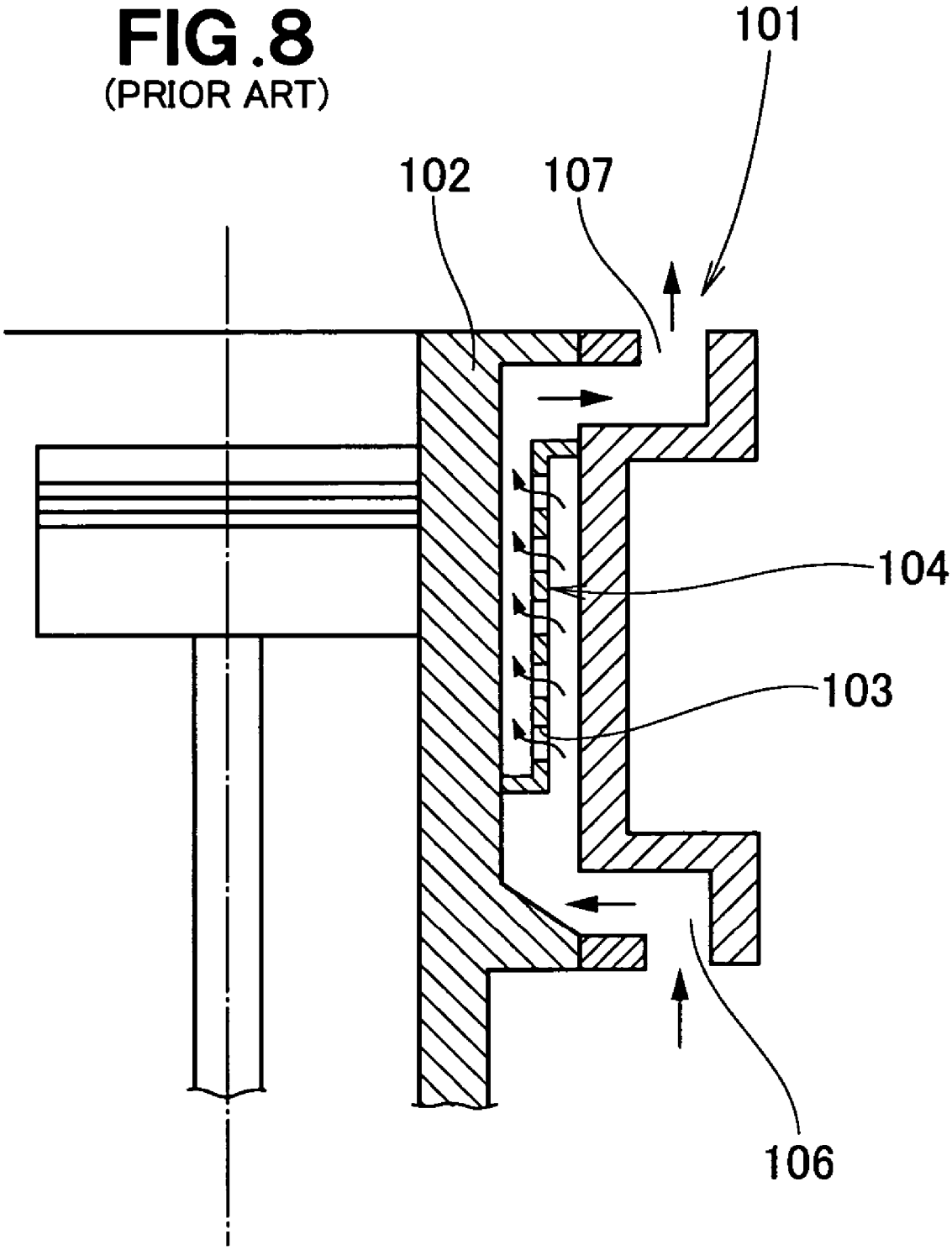
FIG.8 (PRIOR ART)
FIG. 8 is a cross-sectional view of a conventional cylinder liner cooling structure.
Figure 9A:
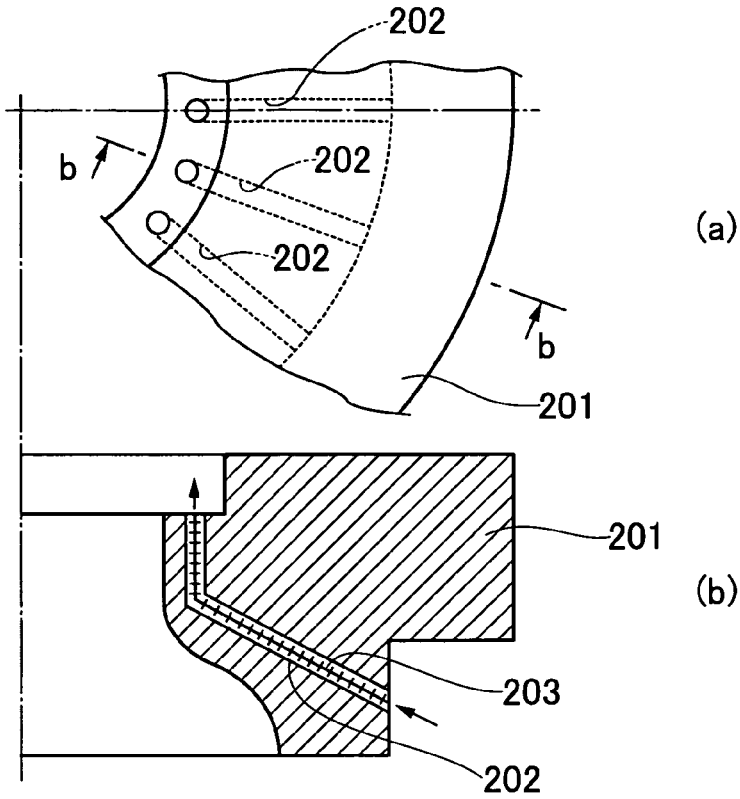
FIG.9A (PRIOR ART)
FIG. 9 illustrates another conventional cylinder liner cooling structure; (a) is a plan view; (b) is a cross-sectional view along line b—b in (a)
Figure 10A:
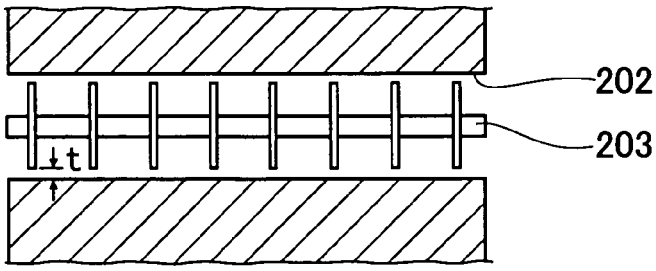
FIG.10A (PRIOR ART)
FIGS. 10A and 10B are diagrams illustrating the operation of the cooling structure shown in FIG. 9.
Figure 10B:
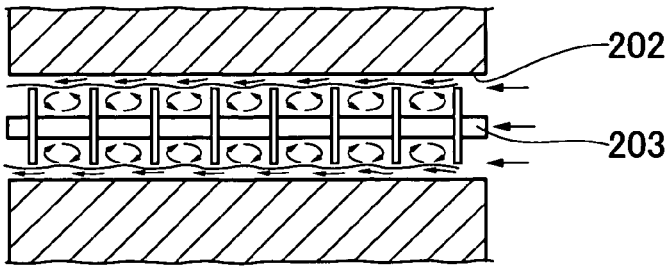
FIG.10B (PRIOR ART)

As shown in FIG. 7, coolant jetting from the coolant passages 63 into the third water reservoir 77 strikes the inner wall 54*a* of the third water reservoir 77 substantially vertically, thereby generating turbulent flow widely within the third water reservoir 77. As a result, the cylinder liner 12, particularly upper part which is heated extra, is cooled circumferentially substantially uniformly and effectively reduced in temperature.

Also, the coolant cooled circumferentially substantially uniformly and having a circumferentially substantially uniform temperature flows directly downward of the water jacket 26. Consequently, the middle and lower portions of the cylinder liner 12 are also made circumferentially substantially uniform in temperature. The coolant cooling the upper portion of the cylinder liner 12, that is, the area near the combustion chamber, a hot section, and increased in temperature flows to the middle and lower portions. Consequently, the temperature of the cylinder liner 12 is also made axially uniform, and heat distortion of the cylinder liner 12 due to temperature difference can be limited. The smallness of heat distortion facilitates the production of a piston (if heat distortion is great, elliptical work or another time-taking work is required), and also is expected to allow simplification of the piston shape.

As described above, the first water reservoir 62 is formed around the water jacket 26; the first water reservoir 62 is connected to the water jacket 26 by the coolant passages 63; and coolant flowing through the coolant passages 63 is caused to flow into and strike the inner wall 54*a* of the water jacket 26 substantially vertically. Consequently, the first water reservoir 62 and the coolant passages 63 can make the circumferential temperature distribution in the water jacket 26 more uniform; the coolant striking the inner wall 54*a* of the water jacket 26 from the coolant passages 63 can enhance generation of turbulent flow in the coolant; and the efficiency of heat transfer from the cylinder liner 12 to the coolant can be increased. Thus, the cylinder liner 12 can be more effectively cooled, resulting in increased efficiency of cooling the cylinder liner 12.

Further, since the inner wall 54*a* of the water jacket 26 which coolant flows into and strikes is located at the upper portion of the cylinder liner 12, the upper portion of the cylinder liner 12 which is heated most can be cooled by the coolant. The temperature difference between the upper and lower portions of the cylinder liner 12 can be reduced, and heat distortion of the cylinder liner 12 can be reduced.

Furthermore, since the water jacket 26 is constituted by the cylinder liner 12 and the cylinder block body 21 surrounding the cylinder liner 12, the cylinder liner 12 can be directly cooled by a large flow of coolant within the water jacket 26, resulting in increased cooling efficiency.

Also, since the cylinder liner 12 is surrounded by the water jacket 26, the cylinder liner 12 as a whole can be cooled more uniformly. The temperature distribution in the cylinder liner 12 can thus be made more uniform, and the heat distortion of the cylinder liner 12 can be limited.

Further, compared to a cooling structure formed with a number of elongated bores, the cooling structure using the water jacket 26 can reduce the time of manufacturing the cylinder block 11 (see FIG. 1), resulting in reduced costs.

Furthermore, since the clearance C of the narrow spaces 85 is set at 0.8 mm to 1.0 mm, the flow velocity of coolant flowing through the narrow spaces 85 can be increased to facilitate generation of turbulent flow especially immediately after the coolant flows through the narrow spaces 85. The efficiency of heat transfer from the cylinder liner 12 to the coolant can be increased to effectively cool the cylinder liner 12.

In the present invention, the cylinder block body 21 and the separate cylinder liner 12 form the water jacket 26, and the narrow spaces 85 are formed between the distal edges 53*a* of the fins 53 formed at one of the cylinder block body 21 and the cylinder liner 12, and the other of the cylinder block body 21 and the cylinder liner 12. Thus, the fins 53 can be easily and precisely formed at one of the cylinder block body 21 and the cylinder liner 12, and the clearances C constituting the narrow spaces 85 can be precisely formed.

Consequently, generation of turbulent flow in coolant by the narrow spaces 85 can be made more uniform, and the efficiency of heat transfer from the cylinder liner 12 to the coolant can be made more uniform in all the parts of the cylinder liner 12, resulting in a uniform temperature distribution in the cylinder liner 12.

The cylinder liner 12, a separate part, can be easily replaced when worn. By making the cylinder block body 21 from an aluminum alloy and making the cylinder liner 12 from cast iron, for example, a significant weight reduction can be achieved when compared to making a cylinder block with an integral cylinder liner as a whole from cast iron.

In the embodiment of this invention, as shown in FIG. 2, the example of forming the fins 53 at the outer peripheral surface 51*a* of the cylinder liner 12 is illustrated, which is not limiting. Alternatively, a plurality of fins 53 may be formed at the liner insertion bore 64 in the cylinder block body 21 along a plane orthogonal to the axial direction of the cylinder liner 12.

Obviously, various minor changes and modifications of the present invention are possible in the light of the above teaching. It is therefore to be understood that within the scope of the appended claims the invention may be practiced otherwise than as specifically described.

What is claimed is:

1. A cooling structure for cooling a cylinder liner by circulating coolant supplied from a water pump, in a water jacket formed along an outer periphery of the cylinder liner, the structure comprising:

an annular coolant pool provided around the water jacket for temporarily storing coolant; and a plurality of radial coolant passages for connecting the annular coolant pool to the water jacket;

wherein the coolant flowing through the radial coolant passages is caused to flow into and strike part of a wall defining the water jacket, substantially vertically.

2. The cooling structure as set forth in claim 1, wherein the part of the wall defining the water jacket which the coolant flows into and strikes, is located at an upper portion of the cylinder liner.

3. The cooling structure as set forth in claim 2, wherein the radial coolant passages cause the coolant to flow in an upward direction from the annular coolant pool to another annular coolant pool.

4. The cooling structure as set forth in claim 2, wherein the part of the wall defining the water jacket which the coolant flows into and strikes is an inner wall of another cooling pool.

5. The cooling structure as set forth in claim 1, wherein the water jacket is formed between the outer periphery of the cylinder liner and an inner peripheral wall of a cylinder block body surrounding the cylinder liner.

6. The cooling structure as set forth in claim 1, wherein in the annular coolant pool includes first, second, and third coolant pools, the first coolant pool being formed in a cylinder block body, and the second and third coolant pools being disposed between the cylinder block body and the cylinder liner.

7. The cooling structure as set forth in claim 1, wherein the water jacket formed along an outer periphery of the cylinder liner is shaped to cause at least a portion of the cooling flow to be turbulent.

8. A cooling structure for cooling a cylinder liner by circulating coolant supplied from a water pump, in a water jacket formed along an outer periphery of the cylinder liner, the structure comprising:

the water jacket formed by the cylinder liner and a peripheral wall of a cylinder block body surrounding the cylinder liner;

at least one fin formed at one of the cylinder liner and the peripheral wall; and a narrow space formed between a distal edge of the fin and the other of the cylinder liner and the peripheral wall;

wherein the narrow space causes generation of turbulent flow in the coolant, further comprising a plurality of radial coolant passages that direct the coolant in an inward and upward direction from the cylinder block body to the outer periphery of the cylinder liner.

9. The cooling structure as set forth in claim 8, wherein the narrow space has a width of 0.8 mm to 1.0 mm.

10. The cooling structure as set forth in claim 3, wherein the at least one fin is an annular fin.

11. The cooling structure as set forth in claim 8, wherein the at least one fin is an annular fin is a plurality of fins separated by inter-fin spaces, the turbulent flow occurring the in the inter-fin spaces.

12. A cooling structure for cooling a cylinder liner by circulating coolant supplied from a water pump, in a water jacket formed along an outer periphery of the cylinder liner, the structure comprising:

a cylinder block body constituting one side wall defining the water jacket the cylinder liner separate from the cylinder block body;

the cylinder liner being fitted in the cylinder block body, constituting another side wall defining the water jacket;

at least one fin formed at one of the cylinder block body and the cylinder liner and located within the water jacket; and a narrow space formed between a distal edge of the fin and the other of the cylinder block body and the cylinder liner, through which the coolant flows, further comprising a plurality of radial coolant passages that direct the coolant in an inward and upward direction from the cylinder block body to the outer periphery of the cylinder liner.

13. The cooling structure as set forth in claim 12, wherein the at least one fin is an annular fin.

14. The cooling structure as set forth in claim 12, wherein the at least one fin is an annular fin is a plurality of fins separated by inter-fin spaces, the turbulent flow occurring the in the inter-fin spaces. 0005If the coolant inlet 106 is only provided at a single location, for example, the coolant does not flow well circumferentially of the water jacket 101, producing areas where the coolant is likely to stagnate. Consequently, high-temperature spots are produced locally in the cylinder liner 102, resulting in a nonuniform temperature distribution in the cylinder liner 102.

* * * * *